United States Patent [19]

Hess

[11] Patent Number: 4,558,209

[45] Date of Patent: Dec. 10, 1985

[54] LOW POWER ELECTRICAL HEATING DEVICE

[76] Inventor: Joachim Hess, Schröplerstr. 37, D-8070 Ingolstadt, Fed. Rep. of Germany

[21] Appl. No.: 689,919

[22] Filed: Jan. 9, 1985

[30] Foreign Application Priority Data

Mar. 8, 1984 [DE] Fed. Rep. of Germany ..... 3408398

[51] Int. Cl.[4] ..... H05B 3/06; H05B 3/50

[52] U.S. Cl. ..... 219/530; 174/52 PE; 165/183; 219/365; 219/540; 219/544

[58] Field of Search ..... 219/345, 365, 530, 540, 219/544; 165/122, 183, 184, 185; 174/52 PE

[56] References Cited

U.S. PATENT DOCUMENTS

| | | | |
|---|---|---|---|
| 2,944,138 | 7/1960 | Goff | 219/540 X |
| 3,488,475 | 1/1970 | Gronwoldt | 219/365 |
| 3,497,677 | 2/1970 | Blain | 219/523 |
| 3,550,680 | 12/1970 | Shriver | 219/540 |
| 4,066,839 | 1/1978 | Cossutta et al. | 174/52 PE |
| 4,104,509 | 8/1978 | Bokestal | 219/544 |
| 4,117,308 | 9/1978 | Boggs et al. | 219/365 |
| 4,352,008 | 9/1982 | Höfer et al. | 219/540 |

*Primary Examiner*—Volodymyr Y. Mayewsky
*Attorney, Agent, or Firm*—Karl F. Ross; Herbert Dubno

[57] ABSTRACT

A low power electrical heating device for use in inhibiting the condensation of moisture in the housing of a piece of electrical equipment has an electrical resistor adapted to be connected to the main current circuit encased in an outer cover of thermally conductive material, the cover having a flat surface at one portion of its exterior periphery. A finned heat radiating body of thermally conductive material defines another flat surface and supports the resistor. The heat radiating body has its flat surface in flush engagement with the flat surface of the resistor for direct heat transfer from said resistor to said heat radiating body.

11 Claims, 2 Drawing Figures

LOW POWER ELECTRICAL HEATING DEVICE

FIELD OF THE INVENTION

This invention relates to low power electrical heating devices for use in the housings of electrical equipment such as fuse boxes, terminal blocks, freezing and clotting point monitors, and the like and including as a heat source at least one electrical resistor connected to the main current line.

BACKGROUND OF THE INVENTION

Low power electrical heating devices are known, being generally required in such environments as fuse boxes, terminal blocks, freezing and clotting point monitors, and the like, in order to inhibit the condensation of moisture in the housings of such equipment. Moisture condensation in essence is the result of the thermal pump effect, i.e. the temperature differences between day and night as well as the temperature differences incident to seasonal changes over the course of the year, on the air confined in the housings. This leads to such defects as increased corrosion, electrical breakdowns in switching equipment, the generation of leakage currents, etc. The principal function of the known low power heating devices thus is to prevent the cooling of the interiors of such housings. This objective is, of course, attained, but nevertheless some disadvantages have been encountered by virtue of the fact that the known heating devices are constructed with the electrical heating resistors open to the atmosphere, i.e. being protected neither against moisture nor against dust. One consequence of this type of construction is that despite high outer surface temperatures, the heat transfer to the surrounding atmosphere is limited. Heating devices characterized by high outer surface temperatures also suffer from another disadvantage, however, in that they cannot be, and in fact are not permitted to be, used in explosion-susceptible environments. When the known low power electric heating devices are incorporated in equipment to protect against the freezing of water-filled pipes or against the dropping of the ambient temperature below the clotting or gelling point of stagnant fluid media, difficulties are also encountered in that the radiation losses are excessive.

OBJECTS OF THE INVENTION

It is an object of the present invention, therefore, to provide a novel and improved low power electrical heating device of the aforesaid class in which the electrical resistor constituting the heat source is fully protected against moisture and dust while heat transfer from the resistor is maximized.

It is also an object of the present invention to provide such a low power electrical heating device which is inexpensive to manufacture, has a long useful life, is essentially malfunction-proof, and can be used safely in explosion-susceptible environments.

SUMMARY OF THE INVENTION

Generally speaking, the objectives of the present invention are attained through the provision of a low power electrical heating device which includes as its heat source at least one electrical resistor connected to the main current line, wherein the improvement comprises that (a) the heat source is a compact heat source, with the resistor being encased in an outer cover of thermally conductive material and the cover having a first flat surface at one portion of its exterior periphery, (b) a finned heat radiating body of thermally conductive material is provided which has a portion thereof defining a second flat surface, the resistor being supported by the heat radiating body with the first flat surface of the cover of the resistor being in flush engagement and in direct heat transfer relation with the second flat surface of the heat radiating body, and (c) the resistor with its outer cover is embedded in a mass of potting compound admixed with a quantity of particles of thermally conductive material, the potting compound thereby providing protection for the resistor against attack by dust and moisture and by virtue of the presence of the thermally conductive particles enhancing the heat transfer between the resistor and the heat radiating body.

By virtue of the complete protection of the heating resistor against moisture or dust or other adverse ambient conditions, the heating device according to the present invention has the advantage that it is immune to ordinary adverse influences and no fear need be had of a premature deterioration of the device. Moreover, because the flat surface contact between the resistor and the finned heat radiating body makes for a good and speedy distribution of the available heat, a heating device according to the present invention is characterized by low outer surface temperatures which will under no circumstances exceed the ignition temperatures of the surrounding atmosphere, so that there is no impediment to the use of such a heating device in a piece of equipment where the risk of explosion exists. Last but not least of the advantages of the present invention is that with the resistor being fully embedded in a mass of potting compound, e.g. epoxy resin, which is admixed with particles of a thermally conductive material, such as quartz dust, an enhanced and faster heat transfer between the resistor and the finned heat radiating body is achieved.

In order to improve the heat transfer from the resistor to the finned heat radiating body still more, it is contemplated by the present invention that the outer cover of the resistor, between the flat surface of which and the flat surface on the medial web of the heat radiating body there may be interposed a film or layer of a thermally conductive paste or gel for adhering the cover to the web, may be provided on the portion of its exterior surface other than the portion where the aforesaid flat surface is provided, with ribs and grooves or other types of projections and/or depressions. The presence of such surface features will not only enhance the anchoring of the potting compound to the resistor cover but will also enhance the heat transfer between the resistor and the potting compound. On the other hand, the outer cover of the resistor may be provided with lateral lugs or flanges adapted to receive fasteners for securing the resistor to the medial web of the heat radiating body, and the aforesaid flat surface of the resistor cover may be extended into the regions of such lugs or flanges, thereby to enlarge the contact area between the cover and the web and in that fashion to enhance the heat transfer from the resistor to the heat radiating body.

It will be apparent, therefore, that the improved heat transfer achieved by the present invention is not a function of the provision of an enlarged resistor. Rather, even in the case of a compact or miniature resistor, this advantage is achieved through the use of the conductive paste, the affixation of the resistor to the heat radiating body with the aid of attachment elements which provide an enlarged contact surface, the provision of the surface area-increasing profile features (ribs, grooves, surface roughening, etc.) on the resistor cover, and the incorporation of particles of thermally conductive material in the potting compound. It goes without saying that as a result of these measures the heat transfer from the finned radiating body to the ambient atmosphere surrounding the heating device is likewise improved.

In accordance with a further feature of the present invention, the flat surface on the finned heat radiating body is provided on a portion of a medial web thereof the thickness of which is appreciably greater than that of the fins. The thicker medical web facilitates a rapid flow of heat energy away from the resistor and provides, as it were, a wide avenue for the flow of the heat energy to the fins. It will be understood, in this regard, that the heat radiating body is made of a material of high thermal conductivity, e.g. aluminum. Other highly thermally conductive materials than aluminum could, of course, be used as well, but the low weight of aluminum makes it an attractive candidate for use in the present invention.

In order to facilitate the potting of the compact heat source and also to create the largest possible heat transfer surface, it is further contemplated by the present invention that two adjacent ones of the fins extending from the thick medial web of the heat radiating body define, together with the portion of the web on which the flat surface is provided, an upwardly open (and cross-sectionally generally U-shaped) channel which can be closed at its opposite ends by a pair of end caps to define a circumferentially closed upwardly open cavity into which the potting compound can be poured. In the event that a greater heating capacity of such a device is desired, the heat radiating body can be provided with fins at both faces of the medial web so as to define two such channels and cavities in back to back and mirror image relation to each other. In such a case, a separate heat source or resistor can be secured to each of the faces of the web. Moreover, the provision of such a cavity at both faces of the web provides the potential advantage that the length of the overall device can be reduced by as much as a half since it will then be possible, if two resistors are to be used, to have these in more or less overlapping positions rather than having one following the other as would be required were they located at the same face of the web of the heat radiating body.

In order to provide a possibility of easily connecting the finned heat radiating body to other elements, it is contemplated that at least some of the fins (other than the ones defining the resistor-receiving cavities) will be provided at their free ends with transversely directed flanges so as to define, especially when such flanges are formed on two adjacent fins and are directed toward each other, a generally C-shaped space. Such C-shaped spaces are well suited for receiving enlarged fastener elements, e.g. bolt heads, nuts and washers, with the flanges providing the requisite bearing surfaces for these elements, and, of course, the provision of the flanges necessarily entails an extension of the total surface area of the fins which will contribute to the enhancement of the heat transfer properties of the heat radiating body.

The invention still further contemplates that such protective or control devices as a bimetallic thermostat, a temperature limiter, or the like, may be provided as adjuncts of the heating device and embedded in the mass of potting compound together with the resistor and the associated wiring. The provision of such devices, which can be readily and inexpensively obtained on the open market, makes it possible, for example, that in the summer when the external temperatures are higher, smaller quantities of heat will be given off than in the winter. Thus, it will be possible to set the thermostat for a range of temperatures, i.e. to switch the current flow through the resistor on at 55° C. and off at 70° C., which will minimize the heat energy generated during the summer relative to that in the winter and will lead to a corresponding savings in energy.

BRIEF DESCRIPTION OF THE DRAWING

The foregoing and other objects, characteristics and advantages of the present invention will be more clearly understood from the following detailed description of a preferred embodiment thereof when read in conjunction with the accompanying drawing, in which.

SPECIFIC DESCRIPTION

Figure 2:
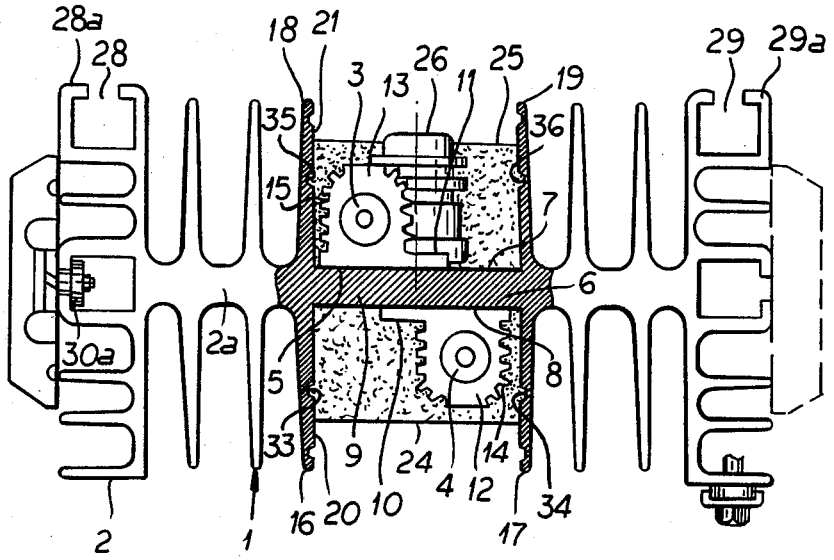
FIG. 2 is an end elevational view of the electric heating device shown in FIG. 1 with parts thereof being shown in section.

Referring now to the drawing in greater detail, the electrical heating device according to the present invention is generally designated by reference numeral 1 and comprises a finned structure 2 to serve as a heat radiating body, and two electrical resistors 3 and 4, in particular compact or miniature resistors, to serve as heat sources. The finned body 2 includes a medial web 2*a* which has a portion 9 located between two pairs of relatively widely spaced fins 16–17 and 18–19 and defining flat upper and lower surfaces 7 and 8. The web is of considerably greater thickness than the fins. The electrical resistors 3 and 4 are encased by respective outer covers 13 and 12 of thermally conductive material (e.g. aluminum) which have flat surfaces 5 and 6 at respective portions of their outer peripheries. As clearly shown in FIG. 2, the resistors 3 and 4 with their outer covers 13 and 12 are supported by the finned heat radiating body 2, with the flat surfaces 5 and 6 of the covers 13 and 12 being in flush engagement and hence in direct heat transfer relation with the flat surfaces 7 and 8 of the web portion 9. The covers 12 and 13 of the resistors 4 and 3 are provided at their respective opposite ends with pairs of apertured flanges or lugs 10 and 11 to enable the covers, and therewith the resistors encased thereby, to be securely fastened, as by screws, to the web portion 9 of the heat-radiating body 2. It will be clear to those skilled in the art, of course, that these fastening lugs serve not only that purpose but also serve to extend the area of surface contact between the resistor covers and the web portion 9 and thereby enhance the heat transfer therebetween.

As will be readily apparent from FIG. 2, the medial web portion 9 and the two pairs of upper and lower fins 18–19 and 16–17 define a pair of upper and lower essentially U-shaped channels 21 and 20 (i.e. channels which are upwardly open with respect to the web portion 9) in which the resistors 3 and 4, a bimetallic thermostat 26, a temperature limiter 27, and the electrical conductors 31 and 32 by means of which the resistors and the various electrical components are connected to the main power circuit, are received. At its opposite ends, each of the channels 21 and 20 is closed by a pair of respective end plates 22 and 23, thereby to enable the appropriate quantities of the initially fluid epoxy resin potting compound to be poured into the channels. The exterior periphery of each of the covers 12 and 13 for the resistors 4 and 3 is further provided, at the portions thereof other than where the flat surfaces 5 and 6 are found, with external ribs or grooves 14 and 15, while the proximate surfaces of the paired fins 16–17 and 18–19 are provided with grooves 33–34 and 35–36. All these elements serve to enhance the interlocking between the masses of solidified potting compound 24 and 25 and the resistor covers 12 and 13 on the one hand, and between the potting compound and the walls of the channels 20 and 21 on the other hand. The ribs and grooves 14 and 15 on the resistor covers 12 and 13 furthermore serve to enhance the heat transfer between the said resistors and the surrounding masses of the potting compound.

Figure 1:
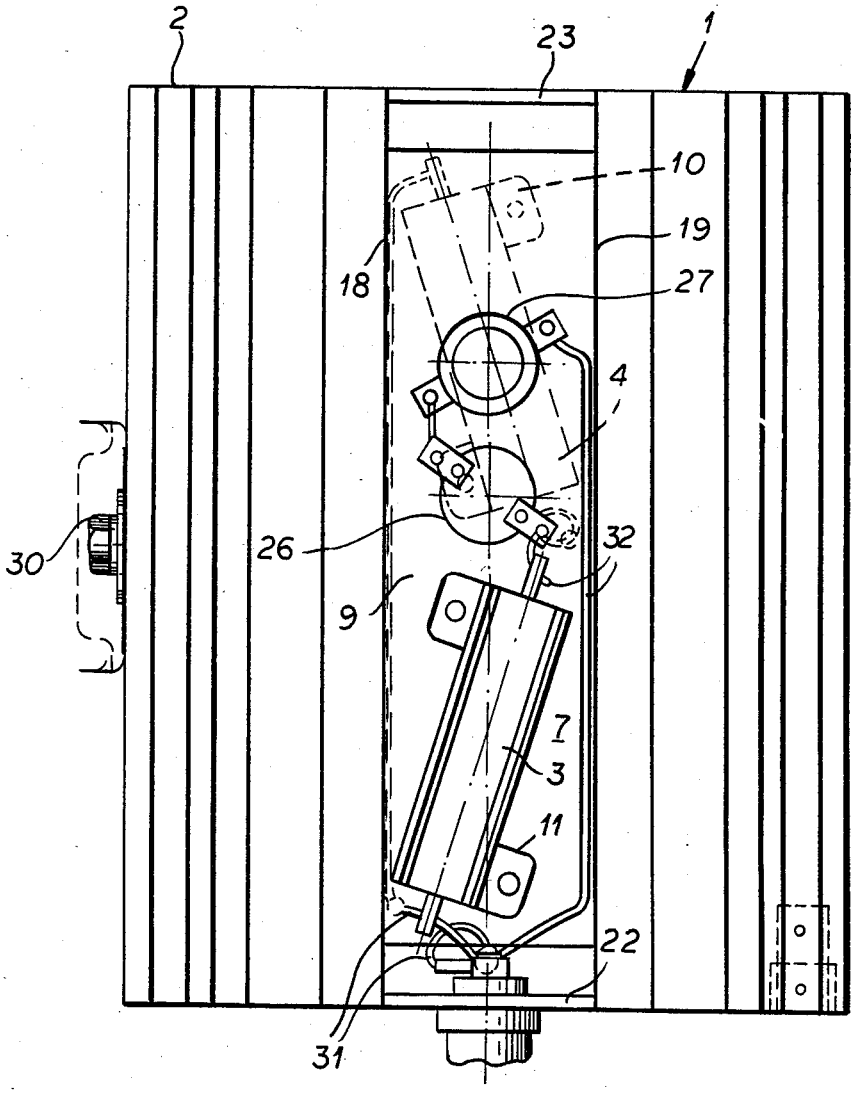
FIG. 1 is a plan view of a low power electrical heating device according to the present invention, with the electrical components being shown in the absence of the potting compound.

As can further be seen from FIG. 2, the finned heat radiating body 2 is, in accordance with a refinement of the present invention, provided at a number of different locations with generally C-shaped fin formations, such as are indicated at 28 and 29, which are defined by flanges 28*a* and 29*a* formed at the outer edges of the respective fins. These C-shaped formations are suited for the attachment of auxiliary equipment or attachment devices to the body 2 by means of fasteners having enlarged elements, e.g. nuts, washers, bolt heads, etc., as is schematically indicated at 30 and 30*a* in FIGS. 1 and 2, respectively.

I claim:

1. In a low power electrical heating device for use in inhibiting the condensation of moisture in the housing of a piece of electrical equipment, which device comprises a heat source including at least one electrical resistor adapted to be connected to the main current circuit;

the improvement comprising that:

(a) said heat source includes an electrical resistor encased in an outer cover of thermally conductive material, said cover having a first flat surface at one portion of its exterior periphery, (b) a finned heat radiating body of thermally conductive material defines a second flat surface, said resistor being supported by said heat radiating body with said first flat surface of the former in flush engagement with said second flat surface of the latter for direct heat transfer from said resistor to said heat radiating body, and (c) said resistor with its outer cover is embedded in a mass of potting compound admixed with a quantity of particles of thermally conductive material, said mass of potting compound providing protection for said resistor against attack by dust and moisture and, through the presence of said thermally conductive particles therein, enhancing the heat transfer between said resistor and said heat radiating body.

2. In a heating device as claimed in claim 1, the improvement comprising that said heat source is a compact heat source.

3. In a low power electrical heating device for use in inhibiting the condensation of moisture in the housing of a piece of electrical equipment, which device comprises a heat source including at least one electrical resistor adapted to be connected to the main current circuit;

the improvement comprising that:

(a) said heat source is a compact heat source and includes an electrical resistor encased in an outer cover of aluminum, said cover having a first flat surface at one portion of its exterior periphery, (b) a finned heat radiating body of aluminum defined a second flat surface, said resistor being supported by said heat radiating body with said first flat surface of the former in flush engagement with said second flat surface of the latter for direct heat transfer from said resistor to said heat radiating body, and (c) said resistor with its outer cover is embedded in a mass of epoxy resin potting compound admixed with a quantity of particles of thermally conductive quartz powder, said mass of potting compound providing protection for said resistor against attack by dust and moisture and, through the presence of said particles of quartz powder therein, enhancing the heat transfer between said resistor and said heat radiating body.

4. In a heating device as claimed in claim 1, 2 or 3, the improvement comprising that said cover of said resistor is provided at a plurality of spaced locations with respective attachment flanges or lugs projecting laterally of said resistor and accommodating fasteners fro securing said resistor to said heat radiating body, said first flat surface extending into the regions of said flanges or lugs for enlarging the region of heat transfer between said resistor and said heat radiating body.

5. In a heating device as claimed in claim 1, 2 or 3, the improvement comprising that said cover of said resistor is provided at portions of its exterior periphery, other than the portion where said first flat surface is located, with a plurality of raised or depressed elements to enable a positive interlocking of said mass of potting compound with said resistor and to enhance the heat transfer from said resistor to said potting compound.

6. In a heating device as claimed in claim 5, the improvement comprising that said cover of said resistor is further provided at a plurality of spaced locations with respective attachment flanges or lugs projecting laterally of said resistor and accommodating fasteners for securing said resistor to said heat radiating body, said first flat surface extending into the regions of said flanges or lugs for enlarging the region of heat transfer between said resistor and said heat radiating body.

7. In a heating device as claimed in claim 1, 2 or 3, the improvement comprising that:

(a) said heat radiating body includes a medial web, a portion of said web defining said second flat surface, and (b) a plurality of relatively thin fins extend transversely from said web, said web being substantially thicker than said fins.

8. In a heating device as claimed in claim 7, the improvement comprising that:

(a) two adjacent ones of said fins at one face of said web are spaced from one another sufficiently to enclose therebetween said portion of said web defining said second flat surface and to define in conjunction with said portion of said web an elongated channel open upwardly with respect to said second flat surface, said resistor thereby being located in said channel, and (b) a pair of end caps are secured to said heat radiating body at the opposite ends of said channel, said two adjacent fins, said portion of said web and said end caps defining the boundaries of a circumferentially closed upwardly open cavity for receiving said potting compound.

9. In a heating device as claimed in claim 8, the improvement comprising that:

(a) said portion of said web defines at the other face of said web another second flat surface corresponding to said first-named second flat surface, (b) said heat radiating body is provided at said other face of said web with a respective plurality of fins and pair of end caps which define with said portion of said web the boundaries of a second circumferentially closed upwardly open cavity in a mirror image arrangement to said first-named cavity, and (c) a second resistor having an outer cover with a respective first flat surface in engagement with said other second flat surface is supported by said portion of said web in said second cavity and is there embedded in a respective mass of said plotting compound.

10. In a heating device as claimed in claim 8, the improvement comprising that at least one of said fins other than said two adjacent ones is shaped to define a transverse flange along its outermost edge, thereby to define with its next adjacent fin a generally C-shaped space.

11. In a heating device as claimed in claim 1, 2 or 3, the improvement comprising that a bimetallic thermostat and a temperature limiting device are connected in circuit with said resistor and are embedded in said mass of potting compound.

* * * * *